US005653170A

United States Patent [19]

Puschnerat et al.

[11] Patent Number: 5,653,170

[45] Date of Patent: Aug. 5, 1997

[54] DEVICE FOR CLAMPING PLATES ON A CYLINDER

[75] Inventors: Helmut Puschnerat, Wachenheim; Peter Schröder, Hessheim, both of Germany

[73] Assignee: Koenig & Bauer-Albert Aktiengesellschaft, Wurzburg, Germany

[21] Appl. No.: 617,142

[22] Filed: Mar. 18, 1996

[30] Foreign Application Priority Data

Mar. 16, 1995 [DE] Germany ..... 195 09 561.8

[51] Int. Cl.[6] ..... B41F 1/28

[52] U.S. Cl. ..... 101/415.1; 101/409

[58] Field of Search ..... 101/415.1, 409

[56] References Cited

U.S. PATENT DOCUMENTS

| | | | |
|---|---|---|---|
| 3,659,525 | 5/1972 | Woessner et al. | 101/415.1 |
| 4,104,968 | 8/1978 | Schwaab et al. | 101/415.1 |
| 4,133,264 | 1/1979 | Fermi et al. | 101/415.1 |
| 4,495,865 | 1/1985 | Kamoda | 101/415.1 |
| 5,010,818 | 4/1991 | Wallschlaeger, Sr. | 101/415.1 |
| 5,062,363 | 11/1991 | Reichel | 101/415.1 |
| 5,123,353 | 6/1992 | Beck | 101/415.1 |
| 5,483,891 | 1/1996 | Reichel | 101/415.1 |
| 5,485,783 | 1/1996 | Rau et al. | 101/378 |

FOREIGN PATENT DOCUMENTS

| | | |
|---|---|---|
| 40 05 093 | 6/1991 | Germany . |
| 42 38 343 | 5/1994 | Germany . |
| 1556389 | 11/1979 | United Kingdom . |

*Primary Examiner*—Edgar S. Burr
*Assistant Examiner*—Leslie Grohusky
*Attorney, Agent, or Firm*—Jones, Tullar & Cooper, P.C.

[57] ABSTRACT

A plate end of a flexible printing plate is clamped or retained in a narrow slit in the surface of a plate cylinder. A rotatable spindle is situated adjacent a radial inner end of the cylinder slit. This spindle carries a group of pressure elements having pressure cams that are engageable with the plate ends during rotation of the spindle and which secure or clamp the plate ends in the narrow cylinder slit.

3 Claims, 3 Drawing Sheets

DEVICE FOR CLAMPING PLATES ON A CYLINDER

FIELD OF THE INVENTION

The present invention is directed generally to a device for clamping a plate on a cylinder. More particularly, the present invention is directed to a device for clamping plates having angled or beveled smooth ends on a cylinder. Most specifically, the present invention is directed to a device for clamping the smooth, beveled or angled ends of a plate on a cylinder in a rotary printing press. The plate receiving cylinder is provided with an axially extending generally, radially directed narrow slit into which the beveled plate ends are insertable. The slit has an inner end which is situated adjacent a pivot lever. Several radially outwardly acting pressure elements are located on the pivot lever and are shiftable circumferentially by rotation of the pivot lever. Such circumferential shifting of the pressure elements will clamp or release the beveled plate ends in the narrow cylinder slit.

DESCRIPTION OF THE PRIOR ART

In the field of rotary printing, it is frequently necessary to attach flexible plates to the surfaces of cylinders. These flexible plates may be printing plates that are attached to printing cylinders, flexible resilient blankets that are attached to blanket cylinders or various spacers or covers that are attached to other press cylinders. Some type of plate end securing assembly is included on the cylinder and is used to engage the plate end or ends and to secure the plate to the cylinder. In order to most effectively utilize the cylinder or roller to which the plate, blanket, sheet or the like is attached, it is important to restrict as little cylinder surface area as possible for the plate end securement devices. This has given rise to cylinders that have narrow slits and to plates or blankets with beveled or angled ends which are received in those slits. The plate beveled ends are held in the slits by friction or by clamping or holding assemblies situated within the cylinder. In such devices, it is often difficult to properly clamp the plate to the cylinder in an expeditious manner.

In the German Patent Publication DE 40 05 093 C1 there is disclosed a device that is usuable to mount a flexible plate on a cylinder of a rotary printing press. In this prior art device, a spindle that is used for securing the ends of the plate is eccentrically and pivotably seated in the cylinder.

A limitation of this prior art device is that the rotatable spindle positioned in the cylinder to which the plate is to be clamped must be accurately positioned. If the spindle is improperly positioned in the cylinder bore, or if the cylinder bore itself is not true and parallel to the axis of the cylinder then the clamping force exerted on the beveled ends of the plate will not be uniform across the width of the plate. Such an uneven clamping force applied across the plate width may result in slippage of the plate and the application of a non-uniform clamping force.

It will be seen that a need exists for a plate clamping device which overcomes the limitations of the prior art assemblies. The device for clamping plates on a cylinder in accordance with the present invention provides such a device and is a significant improvement over the prior art devices.

SUMMARY OF THE INVENTION

It is an object of the present invention to provide a device for clamping plates on a cylinder.

Another object of the present invention is to provide a device for clamping plates with beveled ends on a cylinder of a rotary printing press.

A further object of the present invention is to provide a device for clamping a beveled end of a flexible plate received in a narrow slit in a cylinder.

Still another object of the present invention is to provide a device for clamping at least one beveled or angled end of a flexible plate on a plate cylinder of a rotary printing press.

Yet a further object of the present invention is to provide a device for clamping plates on a cylinder which is simple and requires no connections exterior of the cylinder.

As will be discussed in detail in the description of the preferred embodiment which is presented subsequently, the device for clamping plates on a cylinder is usable to clamp the leading and/or trailing beveled ends of a plate that is placed on the cylinder. The beveled plate ends are inserted into an axially extending generally, radially directed narrow slit whose width is only slightly greater than twice the thickness of a beveled plate end. A rotatable pivot lever or spindle is situated in a cylinder bore in the body of the cylinder and has a surface which is generally tangent to an radial inner end of the narrow slit. This spindle carries one or more radially outwardly extending pressure elements that are shiftable circumferentially in the cylinder bore upon rotation of the pivot lever or spindle. These pressure elements have pressure cams that are engageable with the beveled plate ends and that will clamp the plate ends in the narrow slit upon rotation of the pivot lever or spindle in the appropriate direction.

A particular advantage of the device for clamping plates on a cylinder in accordance with the present invention is that at least one end of a beveled or angled end of a flexible plate can be clamped in the narrow slit of the cylinder in a uniform manner over the entire width of the plate end in the slit. The pressure cams are biased radially outwardly from the free ends of the pressure elements by suitable biasing means, such as springs. If the clamping lever or spindle is not properly aligned in the cylinder bore, or if the cylinder bore is not true in the cylinder, the structure of the axially spaced plurality of individual pressure elements with their individually acting pressure cams will insure that the beveled or angled end of the plate will be clamped uniformly across the entire width of the plate end in the narrow slit on the cylinder. Variations of the thickness of the beveled plate ends across the width of the plate will also not adversely affect the uniform clamping force exerted by the plate end clamping device of the present invention.

The manufacturing outlay associated with the plate end clamping device in accordance with the present invention, in comparison with the outlays required by eccentrically seated spindles is reduced. Since the pivot or clamping lever of the present invention is centrally seated in the cylinder bore and further since its clamping force is not dependent on its alignment, it is easier and less costly to manufacture.

The device for clamping plates on a cylinder in accordance with the present invention overcomes the limitations of the prior art. It is a substantial advance in the art.

BRIEF DESCRIPTION OF THE DRAWINGS

While the novel features of the device for clamping plates on a cylinder in accordance with the present invention are set forth with particularly in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
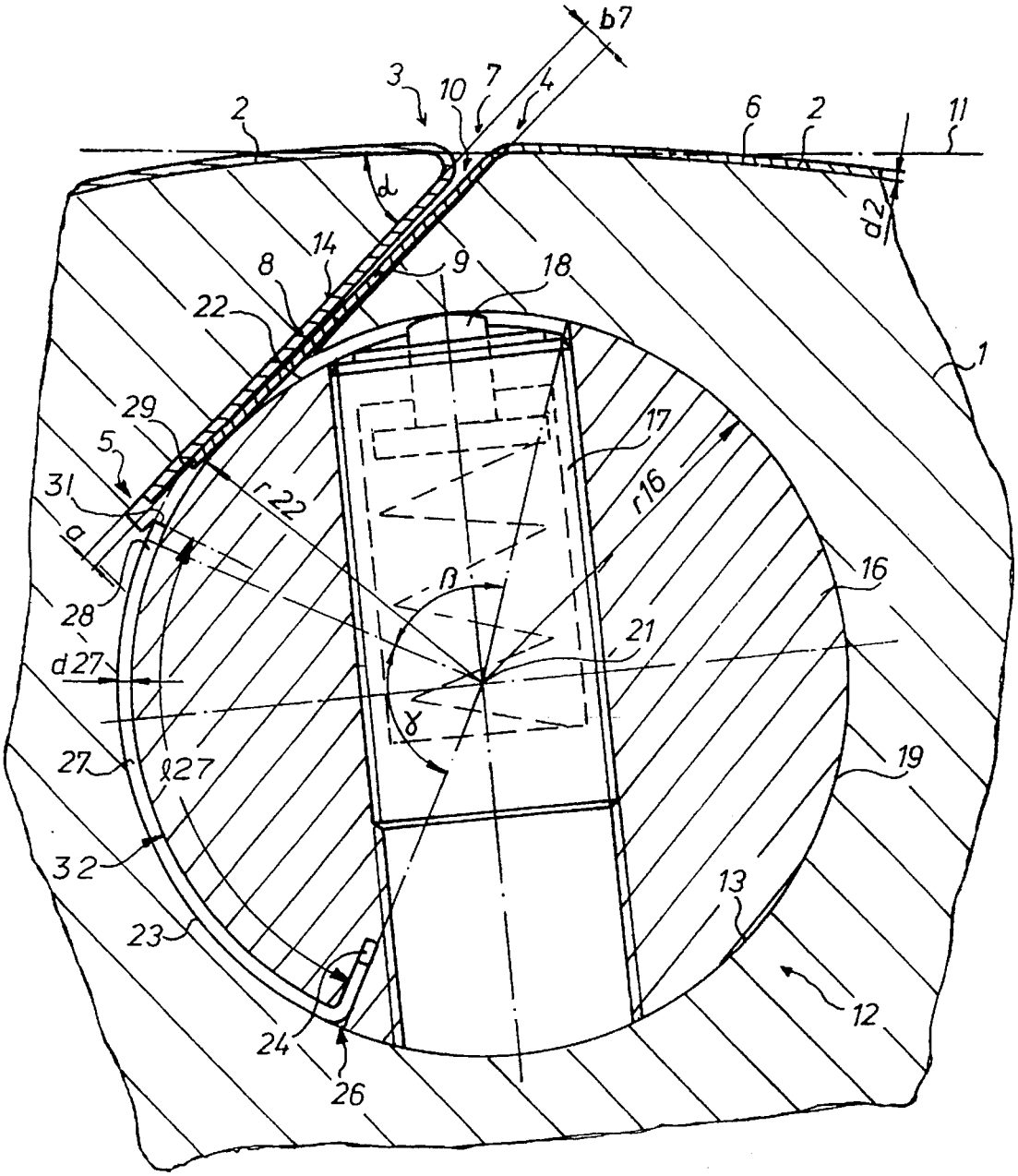
FIG. 1 is a schematic sectional view of a portion of a cylinder in a rotary printing press and showing the device for clamping plates on the cylinder in accordance with the present invention in the plate insertion position.
Figure 2:
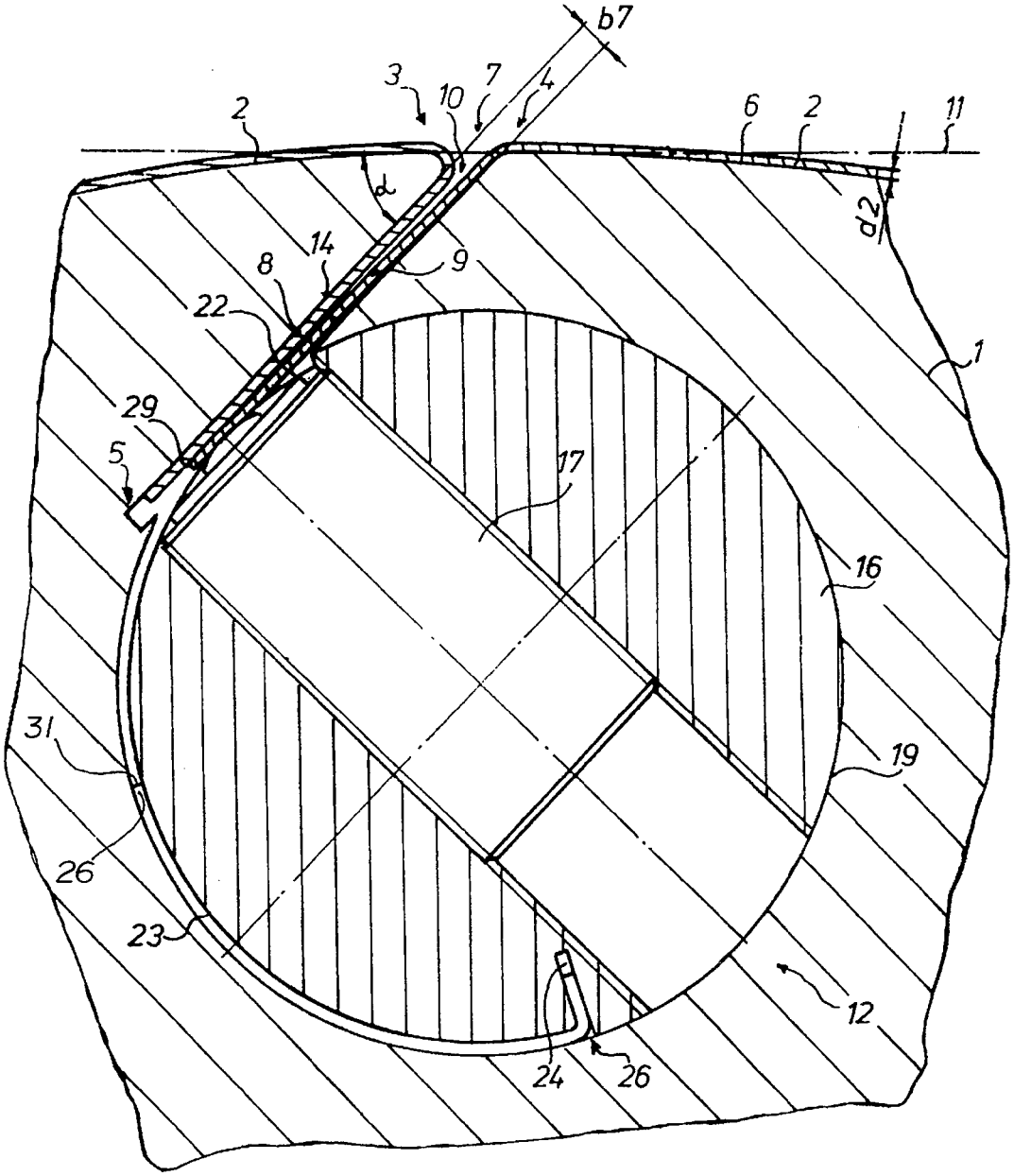
FIG. 2 is a view similar to FIG. 1 and showing the device in the clamping position.
Figure 3:
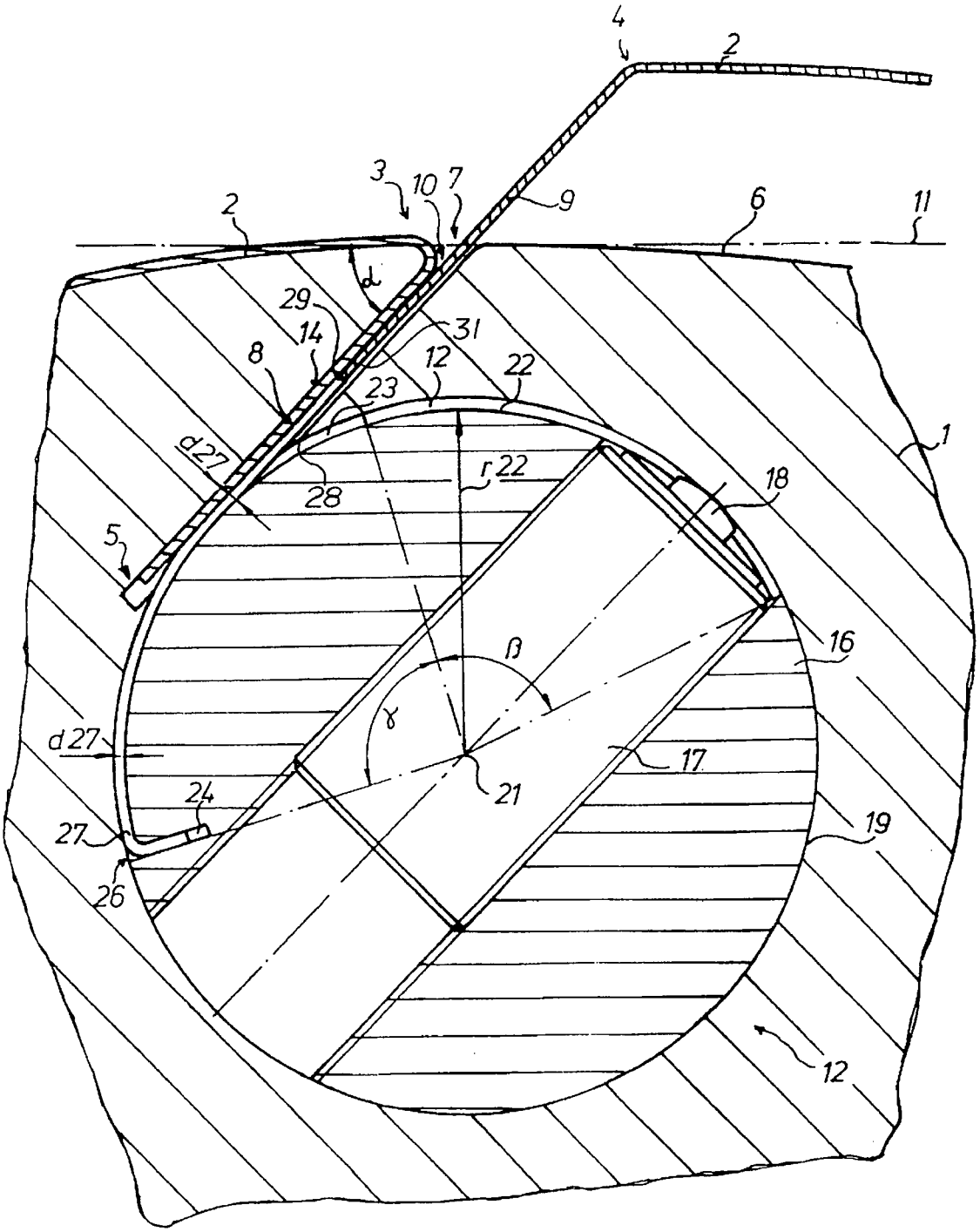
FIG. 3 is a view similar to FIGS. 1 and 2 and showing the device in the ejection position.

Referring initially to FIG. 1, and also referring to FIGS. 2 and 3, there may be seen at 1 a portion of a cylinder which is a part of a rotary printing press and in which the device for clamping plates in accordance with the present invention is situated. It will be understood that cylinder 1 is a plate cylinder that forms part of a rotary printing press. Cylinder 1 could also be a resilient blanket cylinder or another type of cylinder which is utilized in a rotary printing press. The overall structure of the cylinder 1 and of the rotary printing press form no part of the subject invention and are thus not described in detail.

Cylinder 1 is structured to receive flexible printing plates 2 on its surface 6 and is provided with at least one axially extending generally, radially directed thin slit 7 that extends generally radially inwardly in cylinder 1 from a slit outer end 10 at the surface 6 of the cylinder into the cylinder interior 5. The flexible printing plate 2, that is situated on the surface 6 of the cylinder 1, is provided with leading and trailing beveled or angled ends, generally at 3 and 4, respectively. As may be seen in FIGS. 1–3, these leading and trailing beveled plate ends 3 and 4 have leading and trailing legs 8 and 9 respectively which are receivable in narrow slit 7 when flexible plate 2 is positioned on the surface 6 of the cylinder 1.

The flexible plate 2 has a plate thickness d2 of, for example, d2=0.3 mm. This plate, as discussed above, is preferably a printing plate. It may also be a support plate with a rubber blanket fastened to it, or may be another type of plate usable in a rotary printing press. As discussed previously, the leading end 3 of the plate has leading end leg 8 while the trailing end 4 has trailing end leg 9. In the plate 2 depicted in the drawings, the leading end leg 8 is longer than the trailing end leg 9 of the plate 2.

As may be seen in FIGS. 1–3, the narrow slit 7 is preferably generally rectangular in cross-section. The cylinder slit 7 has a width b7 at its outer end 10 which is slightly greater than twice the thickness d2 of the plate 2. Thus b7=1 mm, for example. The slit 7 is inclined at an angle of inclination $\alpha$ of generally 45° with respect to a line 11 which is tangent to the surface 6 of the cylinder 1 at the location of the slit 7.

An axially extending bore 12 is formed in the cylinder 1 and extends parallel with the cylinder slit 7. An inner end of the slit 7 is in contact with the bore 12 and forms a chord with respect to the bore 12. In the subject invention, there is a virtual continuation of a surface area 13 of the bore 12 at a distance "a" in respect to a lateral face 14 of the slit 7 facing away from the bore 12. This distance "a" is slightly greater than the thickness d2 of the plate 2. For example, a=0.4 mm.

A pivot lever 16 which, in the subject invention, is configured as a spindle 16 having a radius r16 of, for example, r16=15 mm, is seated in the bore 12. The pivot lever or spindle 16 is centered in the cylinder bore 12 and is rotatable with respect to the cylinder 1 in the bore 12. A plurality of radially outwardly acting pressure elements, generally at 17, are axially spaced along the length of the spindle 16. These pressure elements 17 are secured in the spindle 16 in such a way that pressure cams 18, which are part of the pressure elements 17, can resiliently act or extend radially outwardly beyond a circumferential surface 19 of the spindle 16. Each of these pressure cams 18 may be provided with a ball or generally rounded end cap at its radially outer end. Other end shapes, such as cylinder segments, are also possible. Each pressure cam 18 forms a contact zone, which may be, for example, linear with the surface of the plate end which it contacts, as seen in FIG. 2.

As may be seen in each of FIGS. 1, 2 and 3, the circumferential surface 19 of the spindle 16 is discontinuous about it circumferential length. In the area of radially outwardly acting pressure elements 17, the surface area 19 of the spindle 16 has a surface area portion 22 of a reduced radius r22 in which r22=14.5 mm. This reduced radius surface area portion 22 has a arcuate length $\beta$ of generally 80° with respect to a longitudinal axis 21 of the spindle 16. This is followed, as may be seen in the drawings, by a second reduced diameter portion 32 extending over an angle $\gamma$ of generally 90° in which this second reduced surface area 32, viewed in the axial direction of the spindle 16, is provided in the form of a plurality of axially spaced generally U-shaped grooves 23 which each extend in the circumferential direction of the spindle 16. Thus the reduced diameter portion of the spindle 16 has a first, continuously reduced diameter portion 22 and a second, discontinuous reduced diameter portion 32. This second, discontinuous reduced diameter portion which is formed by the plurality of axially spaced U-shaped grooves 23, terminates in an axially extending spindle surface channel or slot 24 that is cut into spindle 16 and which extends radially inwardly into the spindle 16 from its surface 19.

A resilient ejector 27 is situated in each of the U-shaped grooves 23 formed in the spindle 16. The width of each spindle groove 23 is sized to receive a corresponding ejector 27. A first end 26 of each resilient ejector 27 is positioned in the spindle channel 24. These resilient ejectors 27 are made of a flexible, elastic but pressure resistent material and in the preferred embodiment are leaf springs made of spring steel. Each of these ejectors has a length l27 of, for example, l27=25 mm. Each ejector is sized to be receivable in its cooperating U-shaped groove 23 on the discontinuous reduced diameter portion 22 of the spindle 16. The length l27 of each ejector 27 is sufficient to bring a free second end 28 of each ejector 27 into the first, continuous reduced diameter portion 22 of the spindle 16. Each ejector 27 has a thickness d27 wherein d27=0.5 mm, for example.

The operation of this device for clamping plates on a cylinder in accordance with the present invention will now be discussed in detail. With the cylinder 1 in a plate end insertion position, as depicted in FIG. 1, the spindle 16 has been rotated so that the first, continuous reduced diameter portion 22 is generally adjacent the radially inner end of the cylinder slit 7. This situates the resilient ejectors 27 beneath or radially inwardly of the slit 7 and the pressure elements 17 out of contact with the cylinder slit 7. In this plate end insertion position, the beveled plate end legs 8 and 9 can be inserted into the slit 7 with the continuous reduced area 22 of the spindle 16 acting as a guide. As soon as the beveled plate end legs 8 and 9 have been fully inserted into the cylinder slit 7 and the flexible plate 2 has been pressed against the surface 6 of the cylinder 1, the spindle 16 will be rotated in a counterclockwise direction into the clamping position which is depicted a FIG. 2. This counterclockwise rotation of the spindle 16 will locate the pressure elements 17 so that they are generally perpendicular with the plate end legs 8 and 9 and so that their pressure cams 18 will bear against these end legs 8 and 9 of the beveled plate ends 3 and 4. These pressure cams 18 may be pressed against the plate end legs 8 and 9 by the force of suitable springs which are carried within the pressure elements, as is depicted in a somewhat schematic fashion in the drawings. This cooperation of the pressure elements 17 carried by the spindle 16, the pressure cams 18 which are part of the pressure elements, and the spring forces and the spring travel which urge the pressure cams 18 into clamping contact with the end legs 8 and 9 of the plate 2 is effective to securely clamp the flexible plate 2 onto the surface of the cylinder 1. The end legs 8 and 9 of the plate 2 are clamped in the narrow slit 7 of the cylinder 1 by the action of the pressure cams 18 which stretch and pull the plate end legs 8 and 9 radially inwardly into the cylinder slit 7. Once the spindle 16 has been turned to the clamped position depicted in FIG. 2, it can be stopped and retained in that position.

Referring now primarily to FIG. 3, when it is desired to release the plate end legs 8 and 9 from the narrow slit 7, the spindle will be rotated in a clockwise direction into a plate end ejection position. As the spindle 16 is rotated in this clockwise direction, the pressure elements 17 will move out of contact with the legs 8 and 9 of the plate ends 3 and 4 to thus release the plate ends. This rotation of the spindle 16 brings the pressure elements 17 into the portion of the cylinder bore 12 in which the pressure cams 18 engage the surface 13 of the cylinder bore 12. As the spindle 16 is continued to be rotated in the clockwise direction, the free ends 28 of the resilient ejectors 27 will now reach the area of the trailing end leg 9 of the flexible plate 2. As is shown in FIG. 3 a first face 31 of each ejector free end 28 will abut a front face 29 of the leg 9 of the trailing plate end 4 and will exert a radially outwardly directed force against it. As the spindle 16 is continued to be rotated in a clockwise direction, the resilient ejectors 27 spring out of their U-shaped grooves 23 and extend radially upwardly into the narrow cylinder slit 7. This positions the free ends 28 of the ejectors generally tangentially with respect to the spindle 16 with the ejector free ends 28 extending toward the outer end 10 of the slit 7. The spindle 16 is rotated in its clockwise direction until the free end 28 of each of the resilient ejectors 27 is situated just beneath, but closely adjacent to the surface 6 of the cylinder 1. This has the effect of completely removing the trailing end leg 9 of the flexible plate 2 from the narrow cylinder slit 7. The inherent resiliency of the flexible plate 2 and its intrinsic tension will act to cause the plate trailing end leg 9 to spring out of the cylinder slit 7 once it has been moved to the ejection position depicted generally in FIG. 3.

While the device for clamping plates on a cylinder in accordance with the present invention has been discussed hereinabove as utilizing pressure springs in the pressure elements 17 to urge the pressure cams 18 radially outwardly, it would also be possible to utilize pre-stressed leaf springs in place of the pressure elements 17 and pressure cams 18. Such pre-stressed leaf springs would be arranged in the circumferential direction of the clamping lever or spindle 16 and would extend radially outwardly beyond the surface area 19 of the spindle 16. In addition, the spindle 16 could have a non-circular cross-sectional shape and could, for example, have a rectangular cross-section.

While a preferred embodiment of a device for clamping plate ends on a cylinder in accordance with the present invention has been set forth fully and completely hereinabove, it will be apparent to one of skill in the art that a number of changes in, for example, the overall size of the cylinder, the type of printing being done by the printing press, the drive for the press and the like could be made without departing from the true spirit and scope of the present invention which is accordingly to be limited only by the following claims.

What is claimed is:

1. A device for clamping at least one end leg of a flexible plate having beveled smooth ends on a cylinder of a rotary printing press comprising:

a narrow slit extending axially along said cylinder and directed generally radially into said cylinder from an outer surface of said cylinder, said slit being adapted to receive said at least one plate end leg and having at least one lateral face;

an axially extending bore in said cylinder in contact with said slit;

a pivot spindle rotatably positioned in said bore for rotation between a plate clamping position and a plate ejection position;

a plurality of pressure elements supported spaced axially along said pivot spindle; and an outwardly acting pressure cam on an outer end of each of said pressure elements, each said pressure cam being engagable with said at least one end leg of said flexible plate to clamp said at least one end leg against said lateral face of said slit upon rotation of said pivot spindle into said plate clamping position.

2. The clamping device in accordance with claim 1 further including a spring biasing each said pressure cam outwardly from said associated pressure element.

3. The clamping device of claim 1 wherein said pivot spindle has a circular cross-section.

* * * * *